US006955557B2

(12) United States Patent
Bernat et al.

(10) Patent No.: US 6,955,557 B2
(45) Date of Patent: Oct. 18, 2005

(54) CONNECTOR WITH INSULATION DISPLACEMENT CONTACTS

(75) Inventors: Jean Francois Bernat, Sartrouville (FR); Jean-Merri de Vanssay, Paris (FR); Abdallah Fakhri, Paris (FR); Andreas Huhmann, Espelkamp (DE); Simon Seereiner, Bielefeld (DE)

(73) Assignee: Harting Electronics GmbH & Co. KG (DE)

( * ) Notice: Subject to any disclaimer, the term of this patent is extended or adjusted under 35 U.S.C. 154(b) by 0 days.

(21) Appl. No.: 10/410,994

(22) Filed: Apr. 10, 2003

(65) Prior Publication Data

US 2003/0194901 A1 Oct. 16, 2003

(30) Foreign Application Priority Data

Apr. 13, 2002 (DE) ..... 102 16 491

(51) Int. Cl.[7] ..... H01R 11/20
(52) U.S. Cl. ..... 439/404
(58) Field of Search ..... 439/404, 417

(56) References Cited

U.S. PATENT DOCUMENTS 4,701,138 A * 10/1987 Key ..... 439/417
5,957,720 A * 9/1999 Boudin ..... 439/417
6,017,236 A 1/2000 Yoshida et al. ..... 439/347

FOREIGN PATENT DOCUMENTS

| | | | |
|---|---|---|---|
| DE | 19725732 | 6/1997 | ..... H02G/15/007 |
| DE | 100 39 962 | 8/2000 | ..... H01R/4/24 |
| FR | 2 722 342 | 7/1994 | ..... H01R/9/22 |
| WO | WO 96/01510 | 1/1996 | ..... H01R/43/01 |
| WO | WO 02/15337 | 2/2002 | ..... H01R/4/24 |

* cited by examiner

*Primary Examiner*—Phuong Dinh
(74) *Attorney, Agent, or Firm*—Hayes Soloway P.C.

(57) ABSTRACT

A connector with insulation displacement contacts for connecting electric conductors, in which the insulation displacement contacts are held in a carrier body and the electric conductors are guided in conductor guide channels of a conductor guide component. When the carrier body and conductor guide component are joined together the electric conductors are contacted by the insulation displacement contacts. The carrier body and conductor guide component are joined by means of an assembly tool constructed as a half-shell housing, in which bevels are provided which cooperate with bevels on the conductor guide component, so when the carrier body and the conductor guide component are pressed together in the half-shell housing, the carrier body and conductor guide component are pressed together by mutual displacement on the bevels.

6 Claims, 2 Drawing Sheets

CONNECTOR WITH INSULATION DISPLACEMENT CONTACTS

FIELD OF THE INVENTION

The invention relates to a connector with insulation displacement contacts for connecting electric conductors, wherein the insulation displacement contacts are held in a carrier body, wherein the electric conductors are guided in a conductor guide component in conductor guide channels, and wherein when the carrier body and the conductor guide component are pressed together the electric conductors are pressed into the insulation displacement contacts.

BACKGROUND OF THE INVENTION

A connector of this kind is required to contact connector bodies, designed as rectangular in construction, in which insulation displacement contacts are to be connected to electric conductors, to one another by means of a sliding technique.

From DE 197 25 732 C2 a device for relieving strain is known, in which insulation displacement contacts provided in a round connector undergo axial displacement by means of a radial rotation of the pressure screw, therein pressing the electric conductors threaded in a conductor guide component into the insulation displacement contacts.

This principle cannot, however, be applied with rectangularly shaped connectors.

The object of the invention is therefore to develop a connector of the initially mentioned kind to the effect that the insulation displacement contacts provided in a rectangularly shaped connector are connected to electric conductors by means of a linear slide mechanism.

SUMMARY OF THE INVENTION

This object is achieved in that the carrier body with the conductor guide component is placed in a half-shell housing, wherein the carrier body rests against shoulders on the half-shell housing, sloping faces are provided on the half-shell housing which cooperate with sloping faces on the conductor guide component and when the carrier body and the conductor guide component are pressed into the half-shell housing the sloping face of the conductor guide component slides along on the sloping face of the half-shell housing, wherein the conductor guide component is moved in the direction of the carrier body, wherein the electric conductors are pressed into the insulation displacement contacts.

The advantages achieved with the invention consist particularly in that a simple, assembly-friendly connection of stranded wire conductors to insulation displacement contacts is enabled for rectangularly shaped connectors. By applying a pressure force on a half-shell housing, constructed as an assembly tool, with the carrier body placed therein and the conductor guide component joined thereto, the carrier body and the conductor guide component are therein pushed together, so the stranded wire conductors inserted in the conductor guide component are pressed into the insulation displacement contacts in the carrier body.

In order to enable a linear pushing together of carrier body and conductor guide component of this kind, sloping faces corresponding to bevels in the conductor guide component are preferably provided in the half-shell housing. Moreover, on one side of the half-shell housing shoulders are provided to which the carrier body is nailed, while the slopes on the other side of the half-shell housing slide with the bevels towards one another and effect a pushing together of carrier body and conductor guide component.

BRIEF DESCRIPTION OF THE DRAWINGS

An embodiment example of the invention is illustrated in the drawings and is explained in greater detail below.

DETAILED DESCRIPTION OF PREFERRED EMBODIMENT

Figure 1:
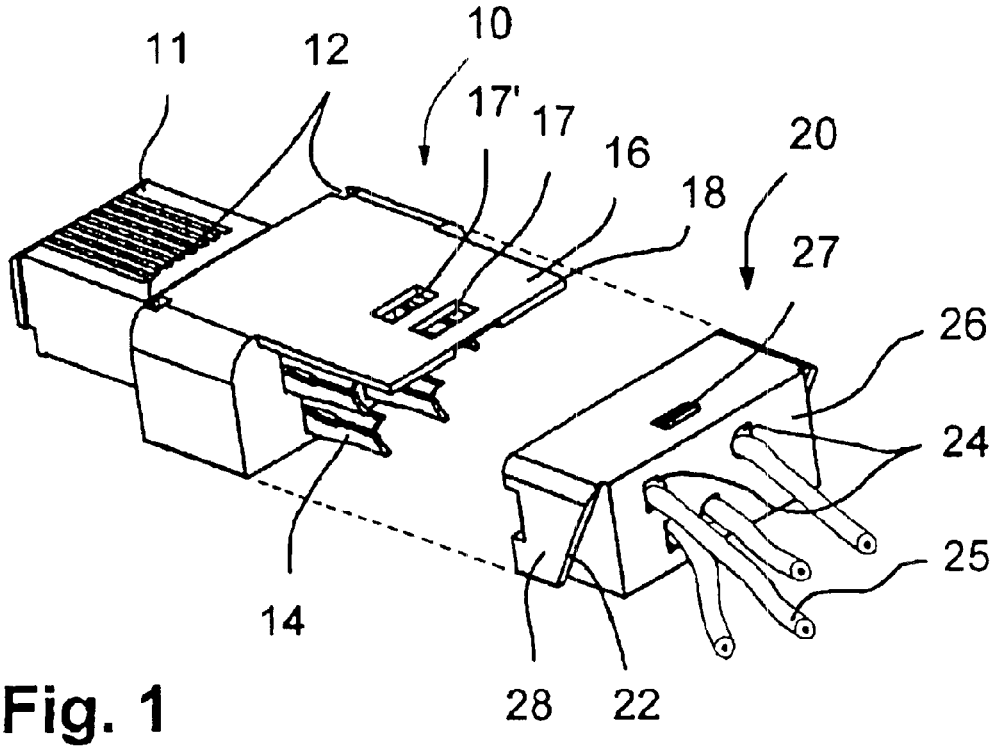
FIG. 1 shows a connector with a carrier body and a conductor guide component.

In FIG. 1 a rectangularly shaped connector, comprising a carrier body 10 with a plug-in side 11 and a connection side and a conductor guide component 20 joined to it, is shown in a disassembled view.

In the carrier body contact elements are held which have on the plug-in side 11 a known RJ 45 plug-in face, while on the connection side, pointing towards the conductor guide component, the contact elements are constructed as insulation displacement contacts 14. On the top of the displacement contacts 14 is a covering face 16 with catching recess 17, 17'.

In the conductor guide component 20 several electric stranded wire conductors 25 can be separately inserted into conductor guide channels 24.

The two plug-in parts—carrier body 10 and conductor guide component 20—are first loosely joined together, wherein the conductor guide component rests on a covering face 16 of the carrier body and occludes with its edge 18. In this pre-assembled position a catching lug 27 on the conductor guide component therein catches in a first catching recess 17 in the covering face 16 of the carrier body. (see also FIG. 3)

At the same time the tips of the insulation displacement contacts 14 are already guided in the conductor guide component 24, while there is still a gap between carrier body and conductor guide component.

On the conductor guide component 20, on the side 26 facing the connection side, a sloping face 22 can be seen, which is arranged symmetrically on both sides in the side faces of the conductor guide component. Because of this slope the section of the side face pointing towards the connection side is designed as narrowed compared to the other side face 28. This results in an edge with the sloping face 22 which has an angle of preferably 30° to the perpendicular.

When carrier body 10 and conductor guide component 20 are plugged together the insulation displacement contacts 14 are arranged inside the conductor guide channels 24 in such a way that the sheathing of the electric conductors guided in the channels is cut through by the insulation displacement contacts and the electric conductors come into electrical contact with the stranded wires.

Figure 2:
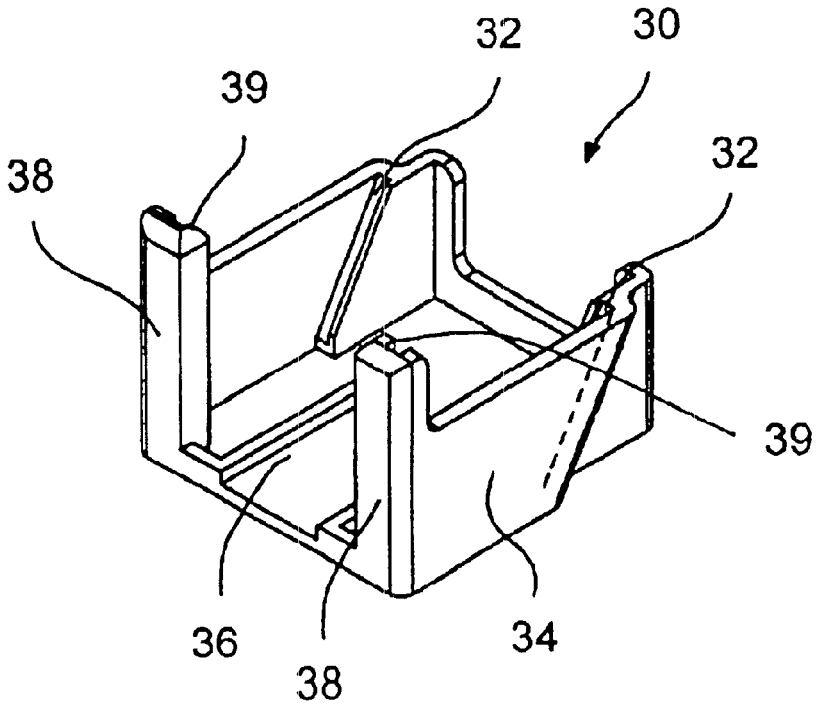
FIG. 2 shows a half-shell housing.

FIG. 2 shows a half-shell housing 30 with a floor 36, at least half-open on three sides, wherein on the side facing the plug-in side shoulders 38, elongated in comparison with the side walls 34, are provided, on which brackets 39 pointing inwards in each case are moulded.

Moreover, a part of the two side faces pointing towards the connection side of the connector is offset inwards, forming an edge with a bevel 32 at an angle of preferably 30°.

When the connector is assembled the carrier body 10 is placed against these shoulders, wherein the brackets 39 engage in each case in a guide groove 12 in the carrier body, so before lowering into the half-shell housing begins there is already a guide between the carrier body with the joined-on conductor guide component.

Figure 3:
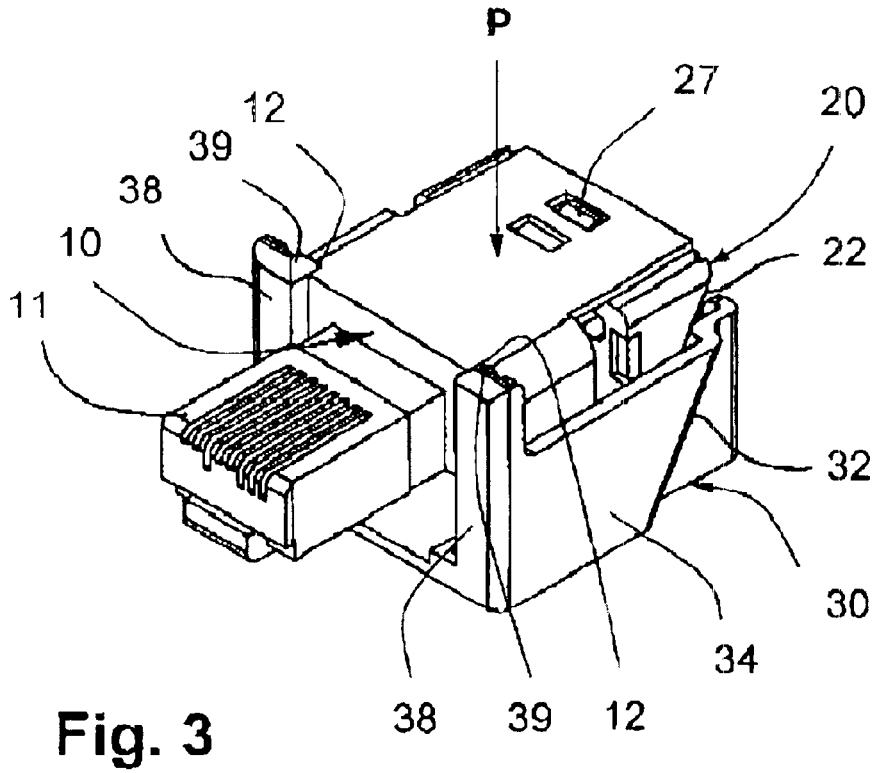
FIG. 3 shows a half-shell housing with a carrier body and conductor guide component placed on top.

FIG. 3 illustrates how the two plug-in parts from FIG. 1—the carrier body 10 and the conductor guide component 20—which are not yet firmly joined together, but have already been pre-assembled, are inserted into the half-shell housing 30. The carrier body is therein first placed with its guide grooves 12 against the brackets 39 of the shoulders 38 and then put into the half-shell housing, so the two sloping faces 22, 32 of the conductor guide component and the half-shell housing lie flush on top of one another.

On application of a pressure force—in FIG. 3 named with an arrow "P"—on the parts now lying on top of one another, owing to the two sloping faces in the half-shell housing 30 and on the conductor guide component 20, the conductor guide component slides linearly in the direction of the carrier body 10, wherein the stranded wire conductors located in the conductor guide component are simultaneously pressed between the insulation displacement contacts. The catching lug 27 therein catches in the second catching recess 17' and holds the carrier body and conductor guide component together.

Figure 4:
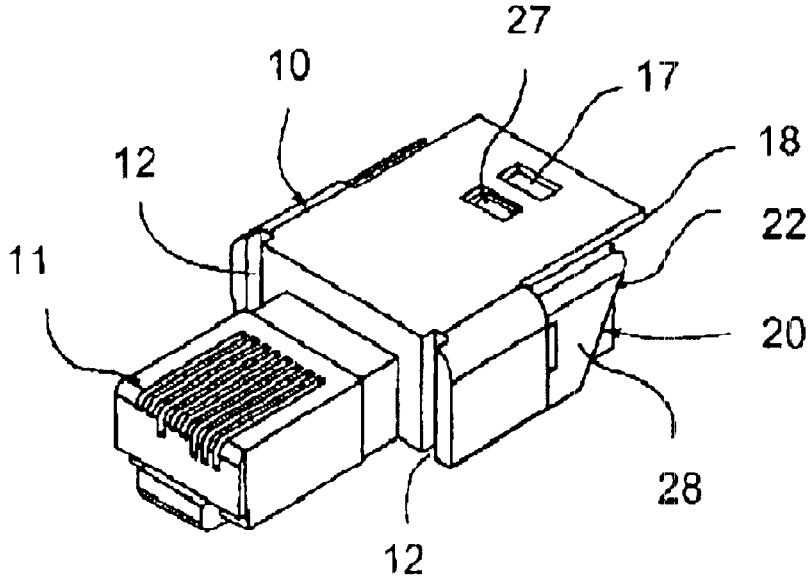
FIG. 4 shows joined together plug-in parts of carrier body and conductor guide component.

In FIG. 4 again an already joined together carrier body 10 with a conductor guide component 20 is shown, the half-shell housing 30 of which has been removed again.

The half-shell housing 30 ultimately serves only as an assembly tool for pushing together the carrier body 10 and the conductor guide component 20.

What is claimed is:

1. Connector with insulation displacement contacts for connecting electric conductors, having insulation displacement contacts held in a carrier body, wherein the electric conductors are guided in a conductor guide component in conductor guide channels, and wherein when the carrier body and conductor guide component are pressed together the electric conductors are pressed into the insulation displacement contacts, wherein the carrier body with the conductor guide component is placed in a half-shell housing, wherein the carrier body rests against shoulders on the half-shell housing, sloping faces which cooperate with sloping faces on the conductor guide component are provided on the half-shell housing and when the carrier body and conductor guide component are pressed into the half-shell housing the sloping face of the conductor guide component slides along on the sloping face of the half-shell housing, wherein the conductor guide component is moved in the direction of the carrier body, wherein the electric conductors are pressed into the insulation displacement contacts.

2. The connector according to claim 1, wherein the sloping faces on the half-shell housing are formed by an offset of the side walls projecting inwards, wherein the slopes preferably run at an angle of 30° to the perpendicular from a floor of the half-shell housing towards a connection side.

3. The connector according the claim 1, wherein on the half-shell housing, shoulders with brackets pointing into the inside of the housing are provided, wherein the shoulders are designed as elongated in comparison to the side walls.

4. The connector according to claim 1, wherein the sloping faces on side faces of the conductor guide component are preferably constructed at an angle of 30° to the perpendicular in the direction towards a connection side.

5. The connector according to claim 1, wherein on the carrier body on its side pointing towards a plug-in side, guide grooves are molded in, into which brackets of shoulders of the half-shell housing engage.

6. The connector according to claim 1, wherein the conductor guide component is provided on its side pointing towards the carrier body with a catching lug, and in a covering face of the carrier body two spaced apart catching recesses are provided, wherein the catching lug of the conductor guide component in a pre-assembled position engages in the first catching recess and in a joined-together position engages in the second catching recess.

* * * * *